United States Patent [19]

Watts

[11] Patent Number: 4,727,897

[45] Date of Patent: Mar. 1, 1988

[54] STABILIZING BRACKET FOR AN AWNING OF A RECREATIONAL VEHICLE

[76] Inventor: Randolph T. Watts, 8517 Pine Glade La., Richmond, Va. 23237

[21] Appl. No.: 929,728

[22] Filed: Nov. 12, 1986

[51] Int. Cl.[4] ..... E04H 15/08; E04F 10/06; B65H 75/18; B65H 18/00

[52] U.S. Cl. ..... 135/89; 135/905; 242/55; 242/73.5; 248/284; 160/69

[58] Field of Search ..... 135/89, 88, 903, 904, 135/905; 242/73.5, 55, 86.52; 160/69, 55, 70, 72, 78, 79; 248/284

[56] References Cited

U.S. PATENT DOCUMENTS

| | | | |
|---|---|---|---|
| 1,377,784 | 5/1921 | Nodland | 242/73.5 |
| 2,138,600 | 11/1938 | Harmon | 248/284 X |
| 2,326,642 | 8/1943 | Heiser | 242/73.5 |
| 3,327,724 | 6/1967 | Nielsen | 135/89 X |
| 3,567,168 | 3/1971 | Jennings | 248/284 |
| 3,722,571 | 3/1973 | Knight et al. | 135/904 X |
| 3,980,121 | 9/1976 | McKee | 135/89 X |
| 4,077,419 | 3/1978 | Lux | 135/89 |
| 4,211,374 | 7/1980 | Salvino | 242/55 |
| 4,524,791 | 6/1985 | Greer | 135/89 |

FOREIGN PATENT DOCUMENTS

| | | | |
|---|---|---|---|
| 171268 | 5/1952 | Austria | 160/79 |
| 3428153 | 8/1985 | Fed. Rep. of Germany | 135/89 |
| 3508918 | 9/1986 | Fed. Rep. of Germany | 135/89 |

*Primary Examiner*—Robert A. Hafer
*Assistant Examiner*—D. Neal Muir
*Attorney, Agent, or Firm*—Norman B. Rainer

[57] ABSTRACT

A stabilizing bracket automatically secures a rolled awning of a recreational vehicle, and automatically releases the awning for its unrolled deployment. The bracket prevents the rolled awning from sagging and rattling against the sidewall of the vehicle during travel. The bracket is comprised of a mounting base pivotably interconnected to an extension arm and mounting head. A trough-like holding panel of circular cylindric contour is positioned atop the mounting head and adapted to receive the rolled awning.

6 Claims, 4 Drawing Figures

STABILIZING BRACKET FOR AN AWNING OF A RECREATIONAL VEHICLE

BACKGROUND OF THE INVENTION

This invention relates to awnings used on recreational vehicles, and more particularly concerns a device for stabilizing such awnings in their rolled and stored state.

Recreational vehicles such as mobile homes and trailers are often equipped with an awning comprised of a compliant fabric or film sheet material capable of being rolled upon a reasonably rigid elongated core in the manner of a windowshade, and stored against the sidewall of the vehicle while supported at each extremity.

It has been found that, during travel at various speeds, the awning in its stored state rattles against the sidewall of the vehicle. Also, the core tends to sag or warp, thereby impairing the operability of the awning and causing water to collect within the rolled awning.

Because of the elevated location of the awning in its stored state, any manually operated means to secure the awning would necessitate the use of a ladder or equivalent means to reach the awning. Such chore can be difficult and hazardous, and would require the same effort to unsecure the awning to permit its deployment.

It is accordingly an object of the present invention to provide a device for automatically securing and releasing a rolled awning in its storage state.

It is another object of this invention to provide a device as in the foregoing object easily installable upon the sidewall of a recreational vehicle.

It is a further object of the present invention to provide a device of the aforesaid nature of rugged and durable construction amenable to low cost manufacture.

These objects and other objects and advantages of the invention will be apparent from the following description.

SUMMARY OF THE INVENTION

The above and other beneficial objects and advantages are accomplished in accordance with the present invention by a bracket device for attachment to the sidewall of a recreational vehicle below the storage position of an awning comprising:

(a) a mounting base of monolithic structure comprising a flat rear panel, and flat side panels perpendicularly emergent from said rear panel in spaced apart parallel relationship, said mounting base being adapted to be attached by said rear panel to said sidewall in a manner to vertically dispose said rear and side panels, said side panels having a pair of horizontally aligned apertures, (b) an extension arm of monolithic structure adapted to be disposed in an upright position and comprising a flat rear panel, and flat side panels perpendicularly emergent from said rear panel in spaced apart parallel relationship, the lower portion of said extension arm being configured to fit between the side panels of said mounting base in close-fitting parallel relationship therewith, the side panels of said extension arm being provided with horizontally aligned paired upper holes and paired lower holes, and said extension arm being pivotably joined to said mounting base by a bolt that extends through the apertures of said mounting base and the lower holes of the extension arm, (c) a mounting head of monolithic structure comprised of a flat upper panel and opposed flat side panels perpendicularly emergent from said upper panel and closely embracing the side panels of said extension arm, said mounting head being pivotably joined to said extension arm by a bolt that penetrates the paired upper holes of said extension arm and aligned paired holes in the side panels of said mounting head, said pivotable joinder disposing the flat upper panel of the mounting head above the upper extremity of the extension arm, and (d) a trough-like holding panel of circular cylindric contour having a radius of curvature between 1½ and 4 inches, having forward and rearward parallel straight edges separated by between 120 degrees and 140 degrees of circular arc, and a length in the axial direction of between about 8 and 12 inches, said holding panel being attached adjacent its forward edge to the upper panel of said mounting head to dispose the axis of said holding panel in a direction perpendicular to the side panels of said mounting base, extension arm and mounting head, (e) the dimensions, configurations and interactions of the aforesaid components being such that when the rear panel of the mounting base is affixed to the sidewall of a vehicle and the extension arm is in its forwardmost pivoted position away from the sidewall while the forward edge of the holding panel is in its rearwardmost pivoted position, the holding panel will support a rolled awning, and (f) when the forward edge of the holding panel in its forwardmost position, the holding panel will discharge said rolled awning.

In preferred embodiments of the invention, the mounting base, extension arm, and mounting head are derived from extruded aluminum forms by cutting said forms transversely to the axis of elongation. The holding panel is preferably fabricated from a section of plastic pipe such as PVC pipe. The site of attachmert of the holding panel to the mounting head is preferably between 40 and 50 degrees of circular arc behind the forward edge of the holding panel. The extent of forward pivotal movement of the extension arm is limited by abutment of its lowermost extremity with the rear panel of said mounting base. The bracket device is preferably adapted to act upon the awning at its mid length.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

Figure 1:
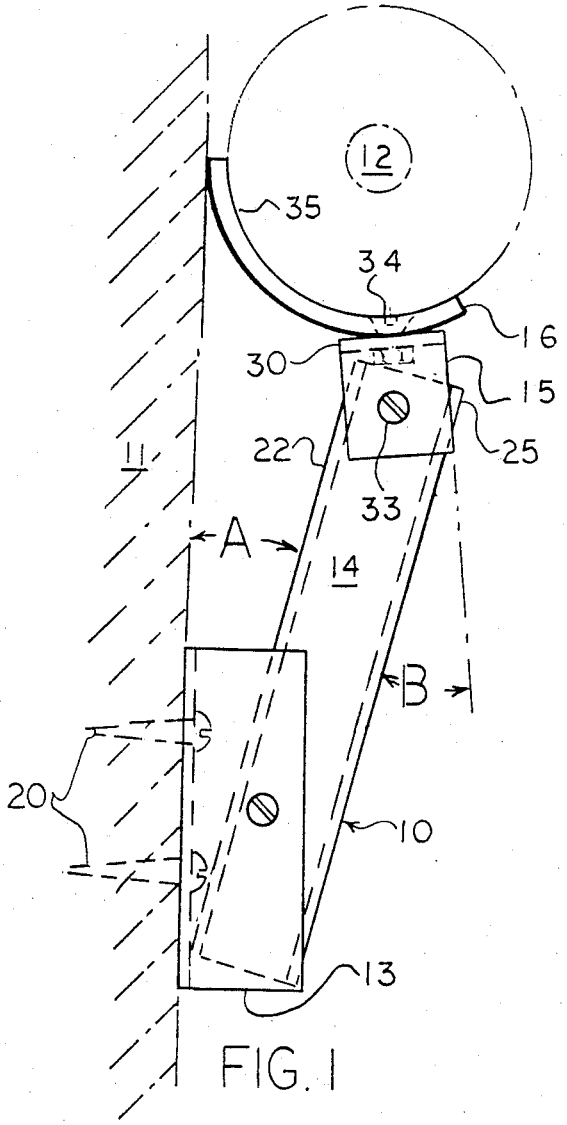
FIG. 1 is a side view of an embodiment of the bracket device of this invention shown mounted upon the sidewall of a vehicle and holding a rolled up awning.
Figure 2:
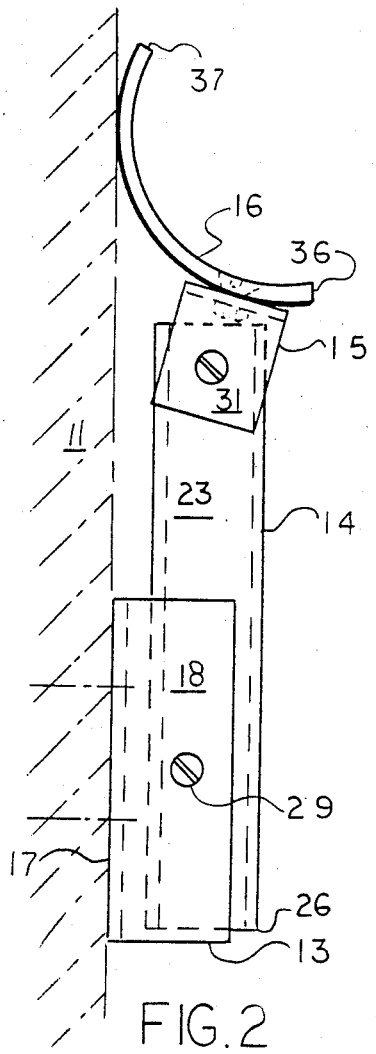
FIG. 2 shows the bracket device of FIG. 1 in a position which discharges said awning.
Figure 3:
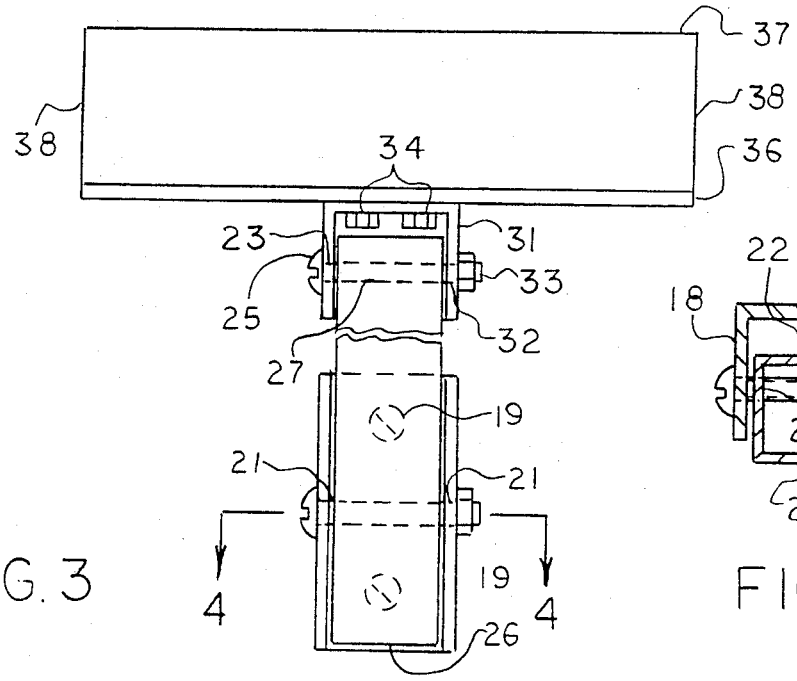
FIG. 3 is a front view of the bracket of FIG. 2.
Figure 4:
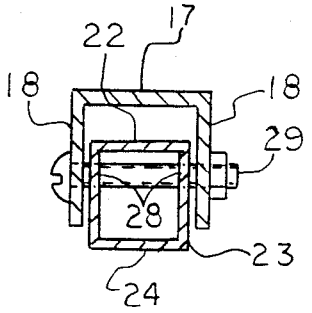
FIG. 4 is sectional view taken along the line 4—4 of FIG. 3.

For ease of description, the terms "forward " or "rearward" or equivalents thereof will have reference to the right and left extremities, respectively, of the device as shown in FIG. 1.

DESCRIPTION OF THE PREFERRED EMBODIMENT

Referring to the drawing, an embodiment of the stabilizing bracket device 10 of this invention is shown affixed to the sidewall 11 of a recreational vehicle and supporting a rolled up awning 12. The bracket device is comprised of mounting base 13. extension arm 14 pivotably joined to base 13 and directed upwardly therefrom, mounting head 15 pivotably attached to the upper extremity of arm 14, and arcuate holding panel 16 attached to the upper extremity of said mounting head.

Mounting base 13 is a monolithic structure comprised of flat rear panel 17, and flat side panels 18 perpendicularly emergent from said rear panel in spaced apart opposed parallel relationship. Apertures 19 are disposed within rear panel 17 to facilitate attachment by penetrative fasteners 20 to the sidewall 11 of the vehicle. The manner in which the mounting base is attached to the sidewall is such as to place side panels 18 in vertical dispositions. A pair of horizontally aligned apertures 21 are disposed within said side panels.

The exemplified embodiment of extension arm 14, fabricated of a length of square tubular metal extruded stock, has a flat rear panel 22, flat side panels 23 and flat front panel 24, said extension arm being of elongated configuration between upper and lower extremities 25 and 26, respectively. The lower portion of the extension arm fits closely between the side panels 18 of said mounting base. The side panels 23 of the extension arm contain horizontally aligned paired upper holes 27 and paired lower holes 28. The extension arm is pivotably joined to mounting base 13 by bolt 29 that extends through apertures 21 of the mounting base and paired lower holes 28 of the extension arm. The position of bolt 29 relative to the lower extremity 26 of the extension arm is critically selected so that said lower extremity abuts against rear panel 17 of the mounting base to limit forward movement of the extension arm. As shown in FIG. 1 the maximum extent of forward positioning of the extension arm is such as to form an angle A with rear panel 17 having a value of about 30 degrees.

Mounting head 15 is comprised of a section cut transversely from a U-channel aluminum extrusion, and is comprised of a flat upper panel 30 and opposed side panels 31 perpendicularly emergent from said upper panel and containing horizontally aligned holes 32. The mounting head is disposed upon extension arm 14 in a manner such that upper panel 30 is above upper extremity 25 of the extension arm and side panels 31 embrace side panels 23 of the extension arm in coplanar disposition with side panels 18 of the mounting base. A bolt 33 penetrates aligned holes 32 in the mounting head and upper holes 27 of the extension arm, thereby causing pivotal joinder. The spacing between upper extremity 25 of the extension arm and upper panel 30 of the mounting head is critically selected so as to enable interabutment which limits the extent of movement of the two components. As shown in FIG. 1 the maximum rearward movement of the mounting head with respect to the extension arm, and shown as the angle B between the forward extremities of the components, is about 30 degrees.

Holding panel 16 is fabricated from a section of PVC (polyvinyl chloride) pipe, and is attached to the upper panel 30 of mounting head 15 by two bolts 34 whose head are flush fitted within the interior surface 35 of holding panel 16. The holding panel is further characterized in having straight parallel forward and rearward edges 36 and 37, respectively, and opposed arcuate side edges 38. The radius of curvature of the holding panel is preferably about 2 inches. The distance of separation between said forward and rearward edges represents between about 120 and 140 degrees of circular arc. The length of the holding panel, measured between arcuate side edges 38, is preferably in the range of 8 to 12 inches. The manner of attachment of the holding panel to the mounting head is such as to dispose the axis of the holding panel perpendicularly to the side panels of the mounting head, extension arm and mounting base. The specific site of attachment is preferably located about 30 degrees of circular arc rearwardly from forward edge 36, and centered between arcuate side edges 38.

By virtue of the dimensions and interaction of the various component parts, it can be seen that the rolled awning is easily supported when it is brought upon holding panel 16 and extension arm 14 is moved forwardly. Release of the awning is achieved simply by pulling the awning away from the sidewall to its unrolled, deployed state. Similarly, the awning can be restored to its secured, storage state merely by pushing the rolled awning onto holding panel 16. On occasion, an elongated pole may be employed to assist movement of arm 14 in either storage or release manipulations.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention what is claimed is:

1. A bracket device for attachment to the sidewall of a recreational vehicle below the storage position of an awning comprising:

(a) a mounting base of monolithic structure comprising a flat rear panel, and flat side panels perpendicularly emergent from said rear panel in spaced apart parallel relationship, said mounting base being adapted to be attached by said rear panel to said sidewall in a manner to vertically dispose said rear and side panels, said side panels having a pair of horizontally aligned apertures, (b) an extension arm of monolithic structure adapted to be disposed in an upright position and comprising a flat rear panel and flat side panels perpendicularly emergent from said rear panel in spaced apart parallel relationship, a lower portion of said extension arm being configured to fit between the side panels of said mounting base in close-fitting parallel relationship therewith, the side panels of said extension arm being provided with horizontally aligned paired upper holes and paired lower holes, and said extension arm being pivotably joined to said mounting base by a bolt that extends through the apertures of said mounting base and the lower holes of the extension arm, (c) a mounting head of monolithic structure comprised of a flat upper panel and opposed flat side panels perpendicularly emergent from said upper panel and closely embracing the side panels of said extension arm, said mounting head being pivotably joined to said extension arm by a bolt that penetrates the paired upper holes of said extension arm and aligned paired holes in the side panels of said mounting head, said pivotable joinder disposing the flat upper panel of the mounting head above the upper extremity of the extension arm and (d) a trough-like holding panel of circular cylindric contour having a radius of curvature between 1½ and 4 inches, having forward and rearward parallel straight edges separated by between 120 degrees and 140 degrees of circular arc, and a length in the axial direction of between about 8 and 12 inches, said holding panel being attached adjacent its forward edge to the upper panel of said mounting head to dispose the axis of said holding panel in a direction perpendicular to the side panels of said mounting base, extension arm and mounting head, (e) the dimensions, configurations and interactions of the aforesaid components being such that when the rear panel of the mounting base is affixed to the sidewall of a vehicle and the extension arm is in its forwardmost pivoted position away from the sidewall while the holding panel is in its rearwardmost pivoted position, the holding panel will support a rolled awning, and (f) when the holding panel is in its forwardmost pivoted position, and when said extension arm is in its rearwardmost pivoted position proximate the sidewall the holding panel will discharge said rolled awning.

2. The bracket device of claim 1 wherein said mounting base, extension arm and mounting head are derived from extruded aluminum forms by cutting said forms transversely to the axis of elongation.

3. The bracket device of claim 1 wherein said holding panel is a section of a circular cylindrical plastic pipe.

4. The bracket device of claim 1 wherein the site of attachment of the holding panel to the mounting head is between 40 and 50 degrees of circular arc behind the forward edge of the holding panel.

5. The bracket device of claim 1 wherein the extent of forward pivotal movement of the extension arm is limited by abutment of its lowermost extremity with the rear panel of said mounting base.

6. The combination of an awning capable of rolled storage against the sidewall of a recreational vehicle, and a bracket device as claimed in claim 1 positioned upon said sidewall at the midpoint of said awning.

* * * * *